US008408731B1

(12) United States Patent
Joyner

(10) Patent No.: US 8,408,731 B1
(45) Date of Patent: Apr. 2, 2013

(54) SAFETY VEST ASSEMBLY

(76) Inventor: Fred Joyner, Sun City Center, FL (US)

( * ) Notice: Subject to any disclaimer, the term of this patent is extended or adjusted under 35 U.S.C. 154(b) by 0 days.

(21) Appl. No.: 13/199,868

(22) Filed: Sep. 13, 2011

(51) Int. Cl.
*F21V 21/08* (2006.01)
*A41D 1/04* (2006.01)

(52) U.S. Cl. ..... 362/108; 2/102

(58) Field of Classification Search ..... 362/103, 362/108; 2/102, 103
See application file for complete search history.

(56) References Cited

U.S. PATENT DOCUMENTS

| | | | | |
|---|---|---|---|---|
| 4,164,008 | A | 8/1979 | Miller et al. | |
| D259,146 | S | 5/1981 | Carr, Jr. | |
| 5,070,436 | A * | 12/1991 | Alexander et al. | 362/108 |
| 5,249,106 | A * | 9/1993 | Barnes et al. | 362/108 |
| 5,424,922 | A | 6/1995 | Wise | |
| 5,570,945 | A | 11/1996 | Chien et al. | |
| D382,679 | S | 8/1997 | Dyson | |
| 5,774,338 | A * | 6/1998 | Wessling, III | 361/730 |
| 5,943,698 | A * | 8/1999 | Blanks | 2/69 |
| D440,716 | S | 4/2001 | Lesley | |
| 6,517,214 | B1 * | 2/2003 | Mitchell et al. | 362/108 |
| 6,554,445 | B1 * | 4/2003 | Jacoby | 362/108 |
| 7,281,813 | B2 | 10/2007 | Golle et al. | |
| 2007/0247834 | A1 | 10/2007 | Turner | |
| 2011/0102304 | A1 * | 5/2011 | Nelson | 345/46 |

* cited by examiner

*Primary Examiner* — Alan Cariaso

(57) ABSTRACT

A safety vest assembly is provided for enhancing visibility of road workers or others in dark conditions. The assembly includes a vest having a rear section having opposite sides. The vest further has a front section coupled to and extending from the opposite sides of the rear section. A first front panel is coupled to a front surface of the vest forming a first front pocket. A first front light is positioned in the first front pocket. The first front light is visible through the first front panel whereby the vest is configured for enhancing visibility of a wearer of the vest.

13 Claims, 4 Drawing Sheets

SAFETY VEST ASSEMBLY

BACKGROUND OF THE DISCLOSURE

Field of the Disclosure

The disclosure relates to safety devices and more particularly pertains to a new safety device for enhancing visibility of road workers in dark conditions.

SUMMARY OF THE DISCLOSURE

An embodiment of the disclosure meets the needs presented above by generally comprising a vest having a rear section having opposite sides. The vest further has a front section coupled to and extending from the opposite sides of the rear section. A first front panel is coupled to a front surface of the vest forming a first front pocket. A first front light is positioned in the first front pocket. The first front light is visible through the first front panel whereby the vest is configured for enhancing visibility of a wearer of the vest.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
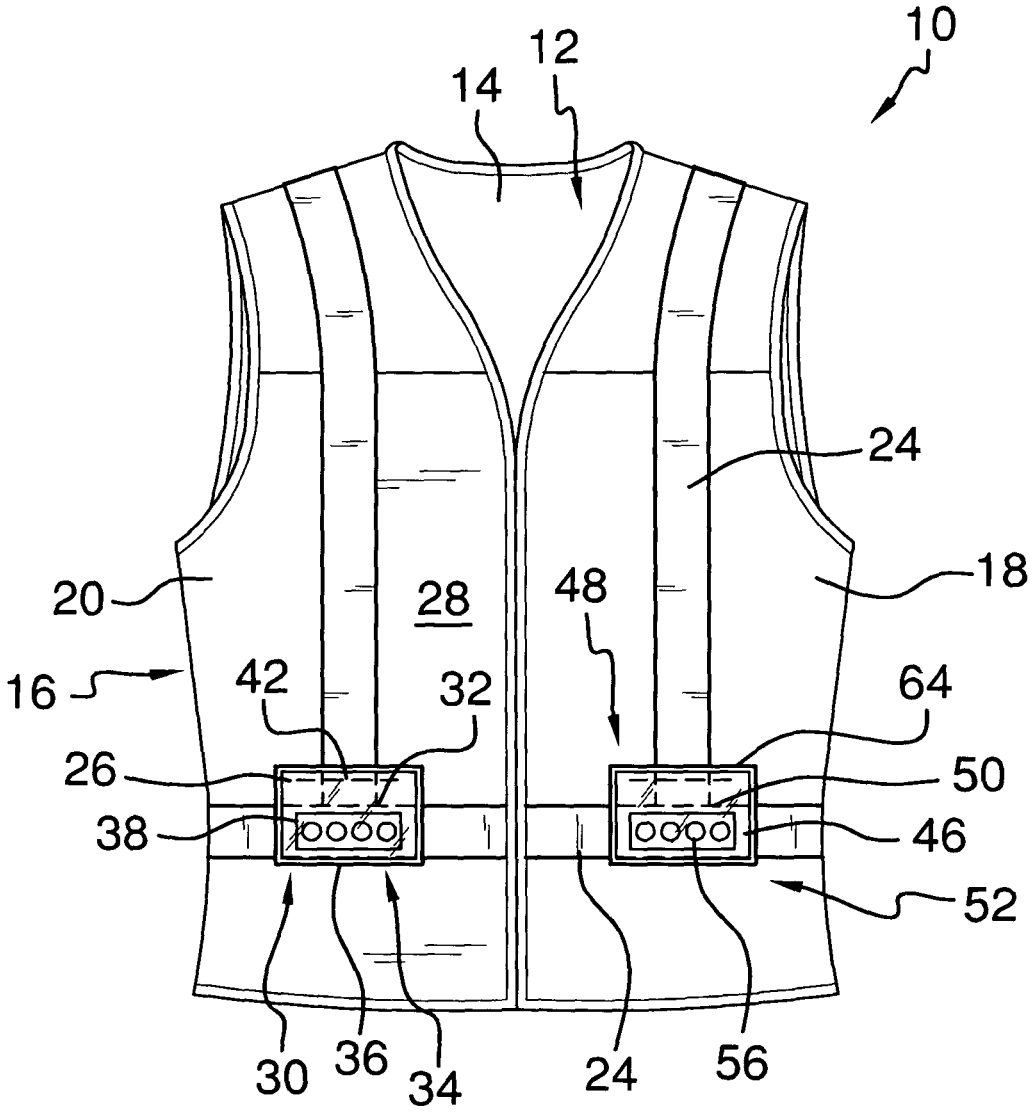
FIG. 1 is a front view of a safety vest assembly according to an embodiment of the disclosure.
Figure 2:
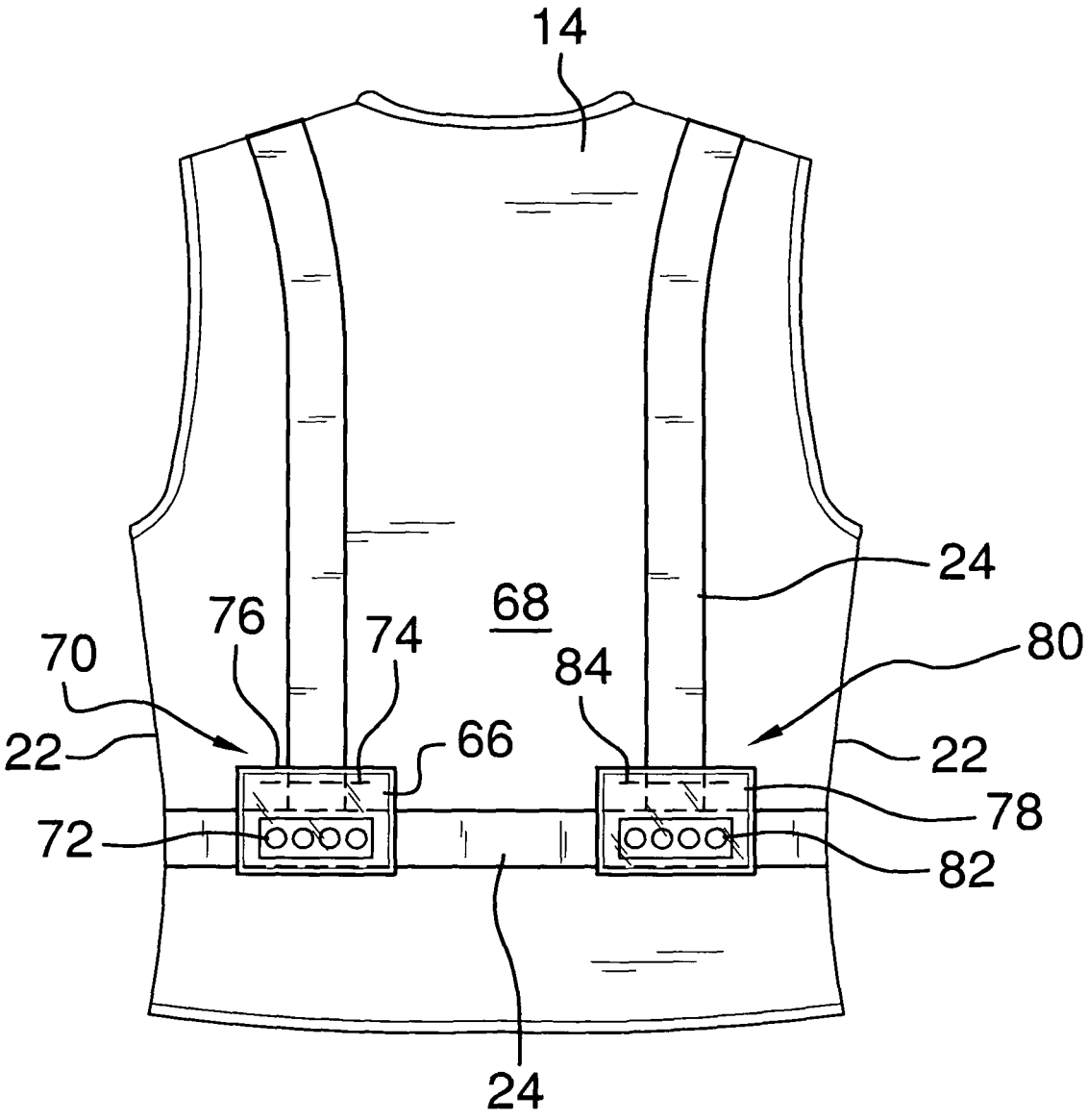
FIG. 2 is a back view of an embodiment of the disclosure.
Figure 3:
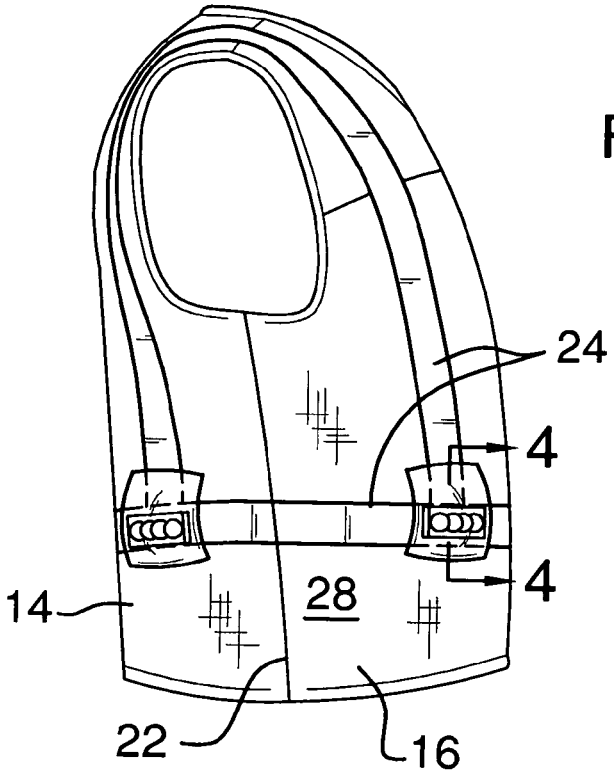
FIG. 3 is a side view of an embodiment of the disclosure.
Figure 4:
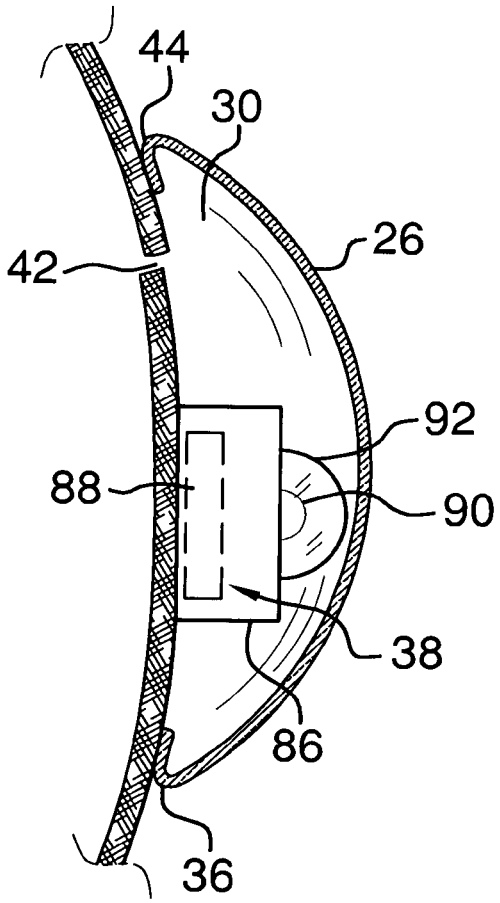
FIG. 4 is a cross-sectional view of an embodiment of the disclosure taken along line 4-4 of FIG. 3.
Figure 5:
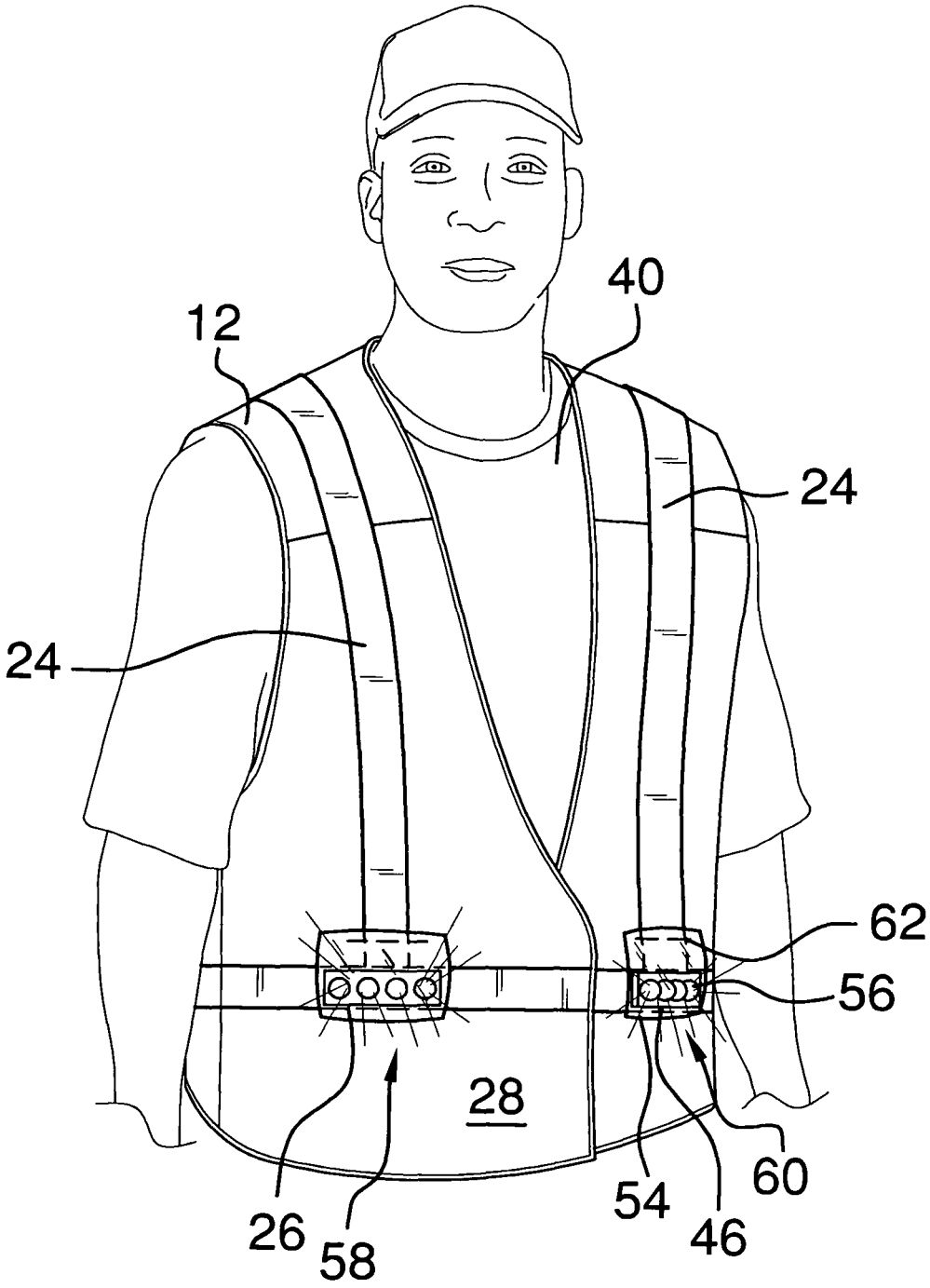
FIG. 5 is a front side view of an embodiment of the disclosure in use.

With reference now to the drawings, and in particular to FIGS. 1 through 5 thereof, a new safety device embodying the principles and concepts of an embodiment of the disclosure and generally designated by the reference numeral 10 will be described.

As best illustrated in FIGS. 1 through 5, the safety vest assembly 10 generally comprises a vest 12 having a rear section 14 and a front section 16. The front section 16 may be provided in a left side portion 18 and a right side portion 20. The rear section 14 has opposite sides 22. The front section 16 is coupled to and extends from the opposite sides 22 of the rear section 14. A plurality of reflective bands 24 may be coupled to the front section 16 and the rear section 14 of the vest 12. A first front panel 26 is coupled to a front surface 28 of the vest 12 forming a first front pocket 30 positioned on the right side portion 20. The first front pocket 30 may be positioned at a junction 32 of a pair 34 of the reflective bands 24. The first front pocket 30 has a bottom edge 36. A first front light 38 is positioned in the first front pocket 30. The first front light 38 is visible through the first front panel 26 whereby the vest 12 is configured for enhancing visibility of a wearer 40 of the vest 12.

A first front slit 42 is positioned in the front section 16 of the vest 12. The bottom edge 36 of the first front pocket 30 is offset from the first front slit 42 so that the first front light 38 is positioned in spaced relationship to the first front slit 42 in the front section 16 of the vest 12 when the first front light 38 is positioned in the first front pocket 30. A top edge 44 of the first front panel 26 is coupled to the front section 16 of the vest 12. The first front panel 26 is positioned over the first front slit 42 in the front section 16 of the vest 12.

A second front panel 46 is coupled to the front surface 28 of the vest 12 forming a second front pocket 48 on the left side portion 18 of the front section 16 of the vest 12. The second front pocket 48 is positioned at a junction 50 of a second pair 52 of the reflective bands 24. The second front pocket 48 has a bottom edge 54. A second front light 56 is positioned in the second front pocket 48. The second front light 56 is visible through the second front panel 46 because the second front panel 46 is made of either transparent or translucent material. The first light 38 may be a first color 58 such as red or orange. The second light 56 may be a second color 60 different than the first color 58, such as blue to provide colors generally associated with law enforcement when the first color 58 is red, or the same as the first color 58, such as orange providing a vest 12 colored to be generally associated with construction.

A second front slit 62 is positioned in the front section 16 of the vest 12. The second front panel 46 is positioned over the second front slit 62 in the front section 16 of the vest 12. The bottom edge 54 of the second front pocket 48 is offset from the second front slit 62 whereby the second front light 56 is positioned in spaced relationship to the second front slit 62 in the front section 16 of the vest 12 when the second front light 56 is positioned in the second front pocket 48. A top edge 64 of the second front panel 46 is coupled to the front section 16 of the vest 12.

A first rear panel 66 is coupled to a rear surface 68 of the vest 12 forming a first rear pocket 70. A first rear light 72 is positioned in the first rear pocket 70 and the first rear light 72 is visible through the first rear panel 66 because the first rear panel 66 is either translucent or transparent. Thus, the vest 12 is configured for enhancing visibility of the wearer 40 of the vest 12 when viewed from a rearward position. A first rear slit 74 is positioned in the rear section 14 of the vest 12. A top edge 76 of the first rear panel 66 is coupled to the rear section 14 of the vest 12 and the first rear panel 66 is positioned over the first rear slit 74 in the rear section 14 of the vest 12.

A second rear panel 78 is coupled to the rear surface 68 of the vest 12 forming a second rear pocket 80. A second rear light 82 is positioned in the second rear pocket 80. The second rear light 82 is visible through the second rear panel 78 because the second rear panel 78 is similarly constructed of transparent or translucent material. A second rear slit 84 is positioned in the rear section 14 of the vest 12 and a top edge 86 of the second rear panel 78 is coupled to the rear section 14 of the vest 12. The second rear panel 78 is positioned over the second rear slit 84 in the rear section 14 of the vest 12. The first rear pocket 70 and second rear pocket 80 may each be positioned at respective junctions between pairs of the reflective bands 24.

The first front light 38, second front light 56, first rear light 72, and second rear light 82 may each be self-contained including a housing 86 surrounding a battery 88 electrically coupled to an LED light 90 or a row of LED lights 90 covered by a clear or colored shroud 92.

In use, the desired colors of lights 38, 56, 72, and 82 are selected and positioned in the respective pockets 30, 48, 70 and 80. The vest 12 is worn like a conventional vest 12 in low light or dusk-like conditions to provide enhanced visibility for the wearer 40.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A safety vest assembly comprising:

a vest having a rear section having opposite sides, said vest further having a front section coupled to and extending from said opposite sides of said rear section;

a first front panel coupled to a front surface of said vest forming a first front pocket;

a first front light positioned in said first front pocket, said first front light being visible through said first front panel whereby said vest is configured for enhancing visibility of a wearer of said vest;

a first front slit positioned said front section of said vest; and a top edge of said first front panel being coupled to said front section of said vest, said first front panel being positioned over said first front slit in said front section of said vest.

2. The assembly of claim 1, further comprising:

a second front panel coupled to said front surface of said vest forming a second front pocket; and a second front light positioned in said second front pocket, said second front light being visible through said second front panel.

3. The assembly of claim 2, further comprising:

a second front slit positioned in said front section of said vest; and a top edge of said second front panel being coupled to said front section of said vest, said second front panel being positioned over said second front slit in said front section of said vest.

4. The assembly of claim 1, further including said first front pocket having a bottom edge, said bottom edge of said first front pocket being offset from said slit farther from said slit than said top edge of said first front panel whereby said first front light is positioned in a bottom portion of said first front pocket in spaced relationship below said first front slit in said front section of said vest when said first front light is positioned in said first front pocket.

5. The assembly of claim 3, further including said second front pocket having a bottom edge, said bottom edge of said second front pocket being offset from said second front slit farther from said slit than said top edge of said second front panel whereby said second front light is positioned in a bottom portion of said second front pocket in spaced relationship below said second front slit in said front section of said vest when said second front light is positioned in said second front pocket.

6. The assembly of claim 2, further including said first light being a first color, said second light being a second color, and said first color being different than said second color.

7. The assembly of claim 1, further comprising:

a first rear panel coupled to a rear surface of said vest forming a first rear pocket; and a first rear light positioned in said first rear pocket, said first rear light being visible through said first rear panel whereby said vest is configured for enhancing visibility of the wearer of the vest when viewed from a rearward position.

8. The assembly of claim 7, further comprising:

a first rear slit positioned in said rear section of said vest; and a top edge of said first rear panel being coupled to said rear section of said vest, said first rear panel being positioned over said first rear slit in said rear section of said vest.

9. The assembly of claim 7, further comprising:

a second rear panel coupled to said rear surface of said vest forming a second rear pocket; and a second rear light positioned in said second rear pocket, said second rear light being visible through said second rear panel.

10. The assembly of claim 9, further comprising:

a second rear slit positioned in said rear section of said vest; and a top edge of said second rear panel being coupled to said rear section of said vest, said second rear panel being positioned over said second rear slit in said rear section of said vest.

11. The assembly of claim 1, further including a plurality of reflective bands coupled to said front section of said vest.

12. The assembly of claim 11, further including said first front pocket being positioned at a junction of a pair of said reflective bands.

13. A safety vest assembly comprising:

a vest having a rear section having opposite sides, said vest further having a front section coupled to and extending from said opposite sides of said rear section;

a plurality of reflective bands coupled to said front section of said vest;

a first front panel coupled to a front surface of said vest forming a first front pocket, said first front pocket being positioned at a junction of a pair of said reflective bands, said first front pocket having a bottom edge;

a first front light positioned in said first front pocket, said first front light being visible through said first front panel whereby said vest is configured for enhancing visibility of a wearer of said vest, said first light being a first color;

a first front slit positioned said front section of said vest, said bottom edge of said first front pocket being offset from said slit farther from said slit than said top edge of said first front panel whereby said first front light is positioned in a bottom portion of said first front pocket in spaced relationship to below said first front slit in said front section of said vest when said first front light is positioned in said first front pocket;

a top edge of said first front panel being coupled to said front section of said vest, said first front panel being positioned over said first front slit in said front section of said vest;

a second front panel coupled to said front surface of said vest forming a second front pocket, said second front pocket being positioned at a junction of a second pair of said reflective bands, said second front pocket having a bottom edge;

a second front light positioned in said second front pocket, said second front light being visible through said second front panel, said second light being a second color, and said first color being different than said second color;

a second front slit positioned in said front section of said vest, said bottom edge of said second front pocket being offset from said second front slit farther from said slit than said top edge of said second front panel whereby said second front light is positioned in a bottom portion of said first front pocket in spaced relationship to below said second front slit in said front section of said vest when said second front light is positioned in said second front pocket;

a top edge of said second front panel being coupled to said front section of said vest, said second front panel being positioned over said second front slit in said front section of said vest;

a first rear panel coupled to a rear surface of said vest forming a first rear pocket;

a first rear light positioned in said first rear pocket, said first rear light being visible through said first rear panel whereby said vest is configured for enhancing visibility of the wearer of the vest when viewed from a rearward position;

a first rear slit positioned in said rear section of said vest;

a top edge of said first rear panel being coupled to said rear section of said vest, said first rear panel being positioned over said first rear slit in said rear section of said vest;

a second rear panel coupled to said rear surface of said vest forming a second rear pocket;

a second rear light positioned in said second rear pocket, said second rear light being visible through said second rear panel;

a second rear slit positioned in said rear section of said vest; and a top edge of said second rear panel being coupled to said rear section of said vest, said second rear panel being positioned over said second rear slit in said rear section of said vest.

* * * * *